US007509999B2

(12) United States Patent
Angelis et al.

(10) Patent No.: US 7,509,999 B2
(45) Date of Patent: Mar. 31, 2009

(54) ARRANGEMENT AND METHOD FOR REMOVING HEAT FROM A COMPONENT WHICH IS TO BE COOLED

(75) Inventors: Walter Georg Angelis, St. Georgen (DE); Siegfried Seidler, Villingen-Schwenningen (DE); Wolfgang Laufer, Aichhalden (DE)

(73) Assignee: EBM-PAPST St. Georgen GmbH & Co. KG, St. Georgen (DE)

( * ) Notice: Subject to any disclaimer, the term of this patent is extended or adjusted under 35 U.S.C. 154(b) by 494 days.

(21) Appl. No.: 10/527,471

(22) PCT Filed: Sep. 26, 2003

(86) PCT No.: PCT/EP03/10729

§ 371 (c)(1),
(2), (4) Date: Mar. 11, 2005

(87) PCT Pub. No.: WO2004/031588

PCT Pub. Date: Apr. 15, 2004

(65) Prior Publication Data

US 2006/0032625 A1 Feb. 16, 2006

(30) Foreign Application Priority Data

Sep. 28, 2002 (DE) ..... 102 45 382

(51) Int. Cl.
*F24F 11/06* (2006.01)

(52) U.S. Cl. ..... 165/247; 165/104.33; 165/80.2; 62/259.2; 361/699

(58) Field of Classification Search ..... 165/247, 165/80.3, 80.4, 80.2, 104.33; 361/699, 687, 361/690, 695, 696, 697, 698; 62/259.2
See application file for complete search history.

(56) References Cited

U.S. PATENT DOCUMENTS 4,558,395 A 12/1985 Yamada et al. ..... 361/385

(Continued)

FOREIGN PATENT DOCUMENTS

DE 41 25 528 C2 2/1992

(Continued)

OTHER PUBLICATIONS

Espacenet English abstract of Wilhelm+/AseaBrown Boveri.

(Continued)

*Primary Examiner*—Ljiljana (Lil) V Ciric
(74) *Attorney, Agent, or Firm*—Milton Oliver, Esq.; Oliver Intellectual Property LLC

(57) ABSTRACT

An arrangement, for heat dissipation from a component that is to be cooled, features: a pump for pumping a coolant, which pump comprises a pump rotor; a fan that comprises a fan rotor associated with which is an electric motor to drive it, the pump rotor and the fan rotor being separated from one another in fluid-tight fashion and drivingly connected to one another via a magnetic coupling. A corresponding method for heat dissipation from a component that is to be cooled, uses a fan having a fan rotor and a drive motor, a pump having a pump rotor, a coolant that is pumpable by means of the pump, to perform the steps of A) imparting a rotational motion to the fan rotor by means of the drive motor; B) imparting a rotational motion to the pump rotor via the magnetic coupling; and C) causing the coolant to flow by the rotational motion of the pump.

39 Claims, 10 Drawing Sheets

U.S. PATENT DOCUMENTS

| | | | | |
|---|---|---|---|---|
| 4,712,388 | A | 12/1987 | Sullivan et al. | 62/514 |
| 5,285,347 | A | 2/1994 | Fox et al. | 361/385 |
| 5,323,847 | A | 6/1994 | Koizumi et al. | 165/104.33 |
| 6,094,345 | A | 7/2000 | Diemunsch | 361/695 |
| 6,208,512 | B1 | 3/2001 | Goldowsky et al. | 361/699 |
| 6,600,649 | B1 | 7/2003 | Tsai et al. | 361/697 |
| 2005/0024824 | A1 | 2/2005 | Riebel et al. | 361/687 |

FOREIGN PATENT DOCUMENTS

| | | |
|---|---|---|
| DE | 103 34 798 | 3/2005 |
| EP | 0 446 836 A1 | 9/1991 |
| EP | 0 558 217 A1 | 2/1994 |

OTHER PUBLICATIONS

Espacenet English abstract of Wilhelm+/ABBPatent GmbH.

ARRANGEMENT AND METHOD FOR REMOVING HEAT FROM A COMPONENT WHICH IS TO BE COOLED

CROSS REFERENCE

This application is a section 371 of PCT/EP2003/010729, filed 26 Sep. 2003, claiming priority from German application DE 102 42 382.9, filed 28 Sep. 2002, the contents of which are incorporated by reference.

FIELD OF THE INVENTION

The invention concerns an arrangement and a method for cooling a component.

BACKGROUND

Many components, in particular electrical components such as microprocessors, are becoming more and more powerful and, at the same times are consuming more and more electrical power.

SUMMARY OF THE INVENTION

It is therefore an object of the invention to make available a new arrangement and a new method for cooling a component.

This object is achieved, according to the present invention, by providing a coolant pump, associated with a fan driven by an electric motor, and magnetically coupling the fan rotor and the pump rotor together, so that no separate pump drive is needed. The magnetic coupling separates the pump region from the fan region in fluid-tight fashion. This ensures that the coolant is continuously available for cooling, and that the coolant does not leak out and cause damage. In addition, only one drive system is needed for the fan and the rotor, with a consequent reduction in parts, weight, and cost.

According to a further aspect of the invention, the object is also achieved by using a drive motor to impart a rotational motion to the fan rotor, using the magnetic coupling between the fan rotor and the pump rotor to cause the pump rotor to also rotate, and causing the coolant to flow as a result of the rotation of the pump rotor. Transfer of the rotary motion of the fan rotor to the pump rotor simplifies construction and decreases the number of parts required.

Further details and advantageous refinements of the invention are evident from the exemplary embodiments, in no way to be understood as a limitation of the invention, that are described below and depicted in the drawings.

BRIEF FIGURE DESCRIPTION

DETAILED DESCRIPTION

Figure 1:
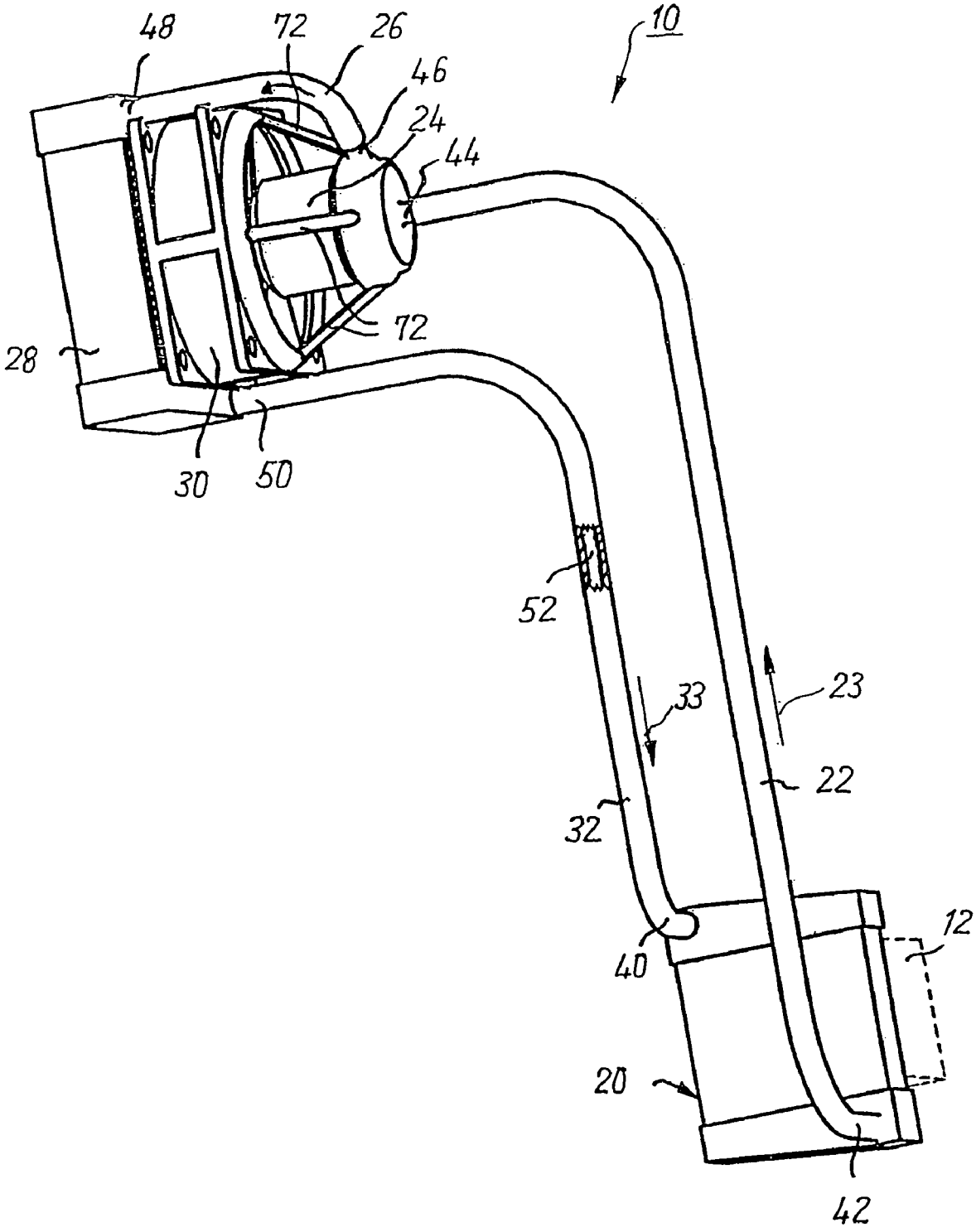
FIG. 1 is a perspective depiction of a preferred embodiment of a fluid cooling apparatus according to the present invention.

FIG. 1 is a perspective depiction of a preferred embodiment of a fluid cooling apparatus 10 according to the present invention. Fluid cooling apparatus 10 preferably serves to cool an electronic component 12 (depicted only schematically), in particular a microcontroller (μC), processor, or microprocessor (μP).

Fluid cooling apparatus 10 comprises a heat absorber 20, a return hose line 22, a fluid pump 24, an interconnecting hose line 26, a heat exchanger 28, a fan 30, and a supply hose line 32. The flow directions are indicated by arrows 23 and 33.

Heat absorber 20 comprises an inlet 40 and an outlet 42, pump 24 an inlet 44 and an outlet 46, and heat exchanger 28 an inlet 48 and an outlet 50.

Outlet 42 of heat absorber 20 is connected via return hose line 22 to inlet 44 of pump 24. Outlet 46 of pump 24 is connected via interconnecting hose line 26 to inlet 48 of heat exchanger 28. Outlet 50 of heat exchanger 28 is connected via supply hose line 32 to inlet 40 of the heat absorber.

Heat absorber 20, return hose line 22, pump 24, interconnecting hose line 26, heat exchanger 28, and supply hose line 32 thus form a cooling circuit in which a coolant 52 can circulate. Coolant 52 can be a fluid, for example a glycol-water mixture (cooling fluid).

Manner of Operation of FIG. 1

Coolant 52 flows through heat absorber 20; at inlet 40 the coolant has a temperature below the surface temperature of processor 12, in heat absorber 20 it absorbs heat from processor 12, and at outlet 42 it has a temperature that is less different from the surface temperature of processor 12 than at inlet 40.

Coolant 52 travels via line 22 to pump 24, which keeps the coolant circuit in motion and pumps it via line 26 to inlet 48 of heat exchanger 28.

Coolant 52 entering heat exchanger 28 has a higher temperature than the air flow, driven by fan 30, entering the air side of the heat exchanger. Heat is thereby transferred from coolant 52 to the air, and coolant 52 cools down.

Lastly, the cooled coolant is delivered through outlet 50 of heat exchanger 28 and line 32 to heat absorber 20 through the latter's inlet 40, in order to cool processor 12.

The arrangement of pump 24 upstream from the inlet of heat exchanger 28 is favorable because a slight heating of coolant 52 takes place during the pumping operation. Because of the greater temperature difference in heat exchanger 28, the latter works more effectively and achieves a greater cooling capacity than if pump 24 were located downstream from heat exchanger 28.

Figure 2:
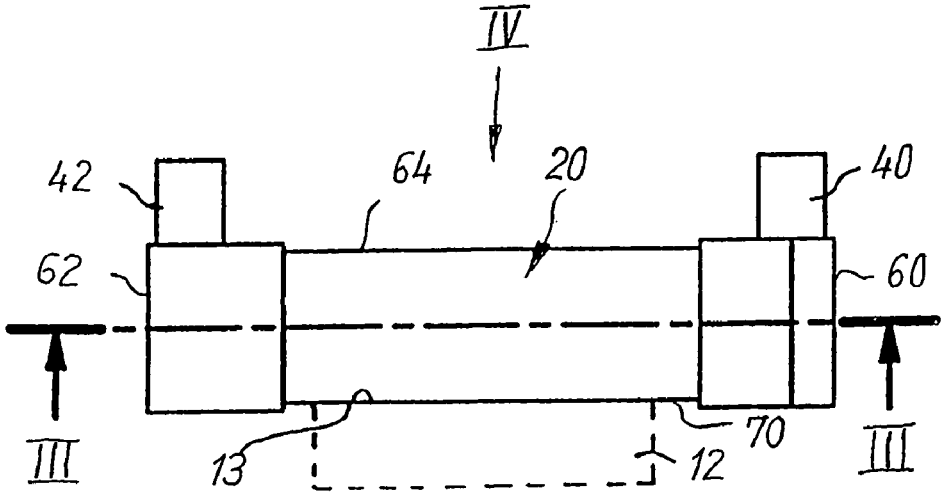
FIG. 2 is a side view of a heat absorber according to the present invention.

FIG. 2 is a side view of heat absorber 20.

Figure 3:
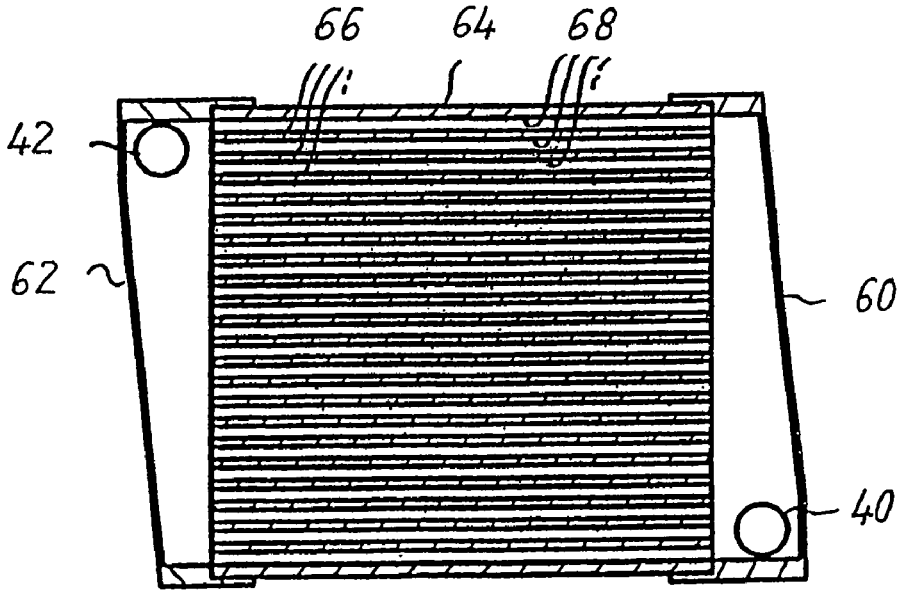
FIG. 3 is a section through the heat absorber, looking along line III-III of FIG. 2.

FIG. 3 is a section through heat absorber 20, looking along line III-III of FIG. 2.

Figure 4:
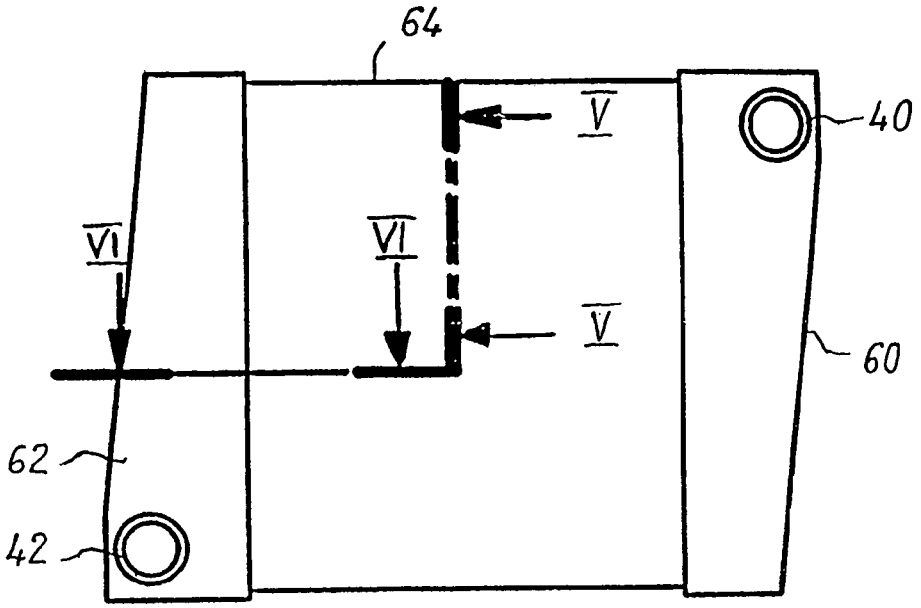
FIG. 4 is a plan view of the heat absorber, looking in the direction of arrow IV of FIG. 3.

FIG. 4 is a plan view of heat absorber 20 from the side facing away from processor 12.

Figure 5:
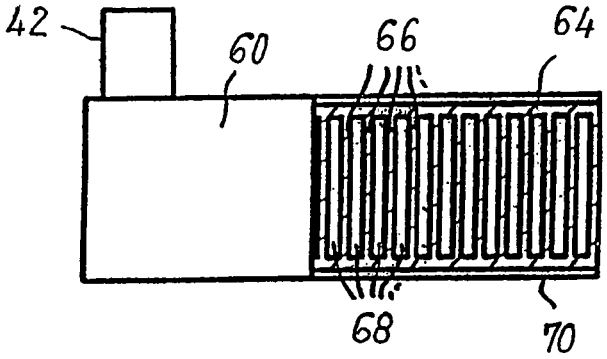
FIG. 5 is a section through the heat absorber, looking along line V-V of FIG. 4.

FIG. 5 is a section through heat absorber 20, looking along line V-V of FIG. 4.

Figure 6:
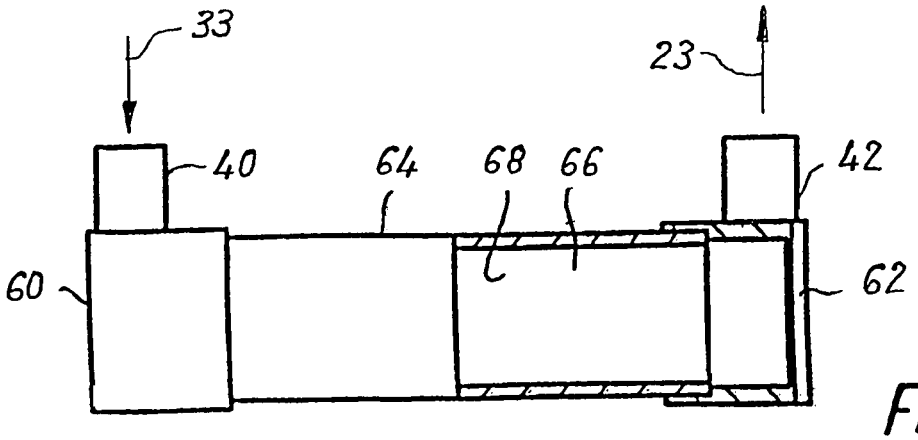
FIG. 6 is a section through the heat absorber, looking along line VI-VI of FIG. 4.

FIG. 6 is a section through heat absorber 20, looking along line VI-VI of FIG. 4.

Heat absorber 20 comprises a heat absorption element 64 having a plurality of plates 66 and conduits 68 located between plates 66, an inlet-side part 60 having inlet 40, and an outlet-side part 62 having outlet 42.

An embodiment of heat absorption element 64 that is preferred in economic terms is manufactured by extrusion from a material having good thermal conductivity. The use of aluminum has proven favorable, since it is inexpensive and offers weight advantages. The low weight greatly reduces the risk of damage to component 12 as a result of dynamic stress.

Inlet-side part 60 and outlet-side part 62 are connected in fluid-tight fashion to heat absorption element 64.

Coolant 52 travels through inlet 40 into inlet-side part 60, and from there via conduits 68 of heat absorption element 64 to outlet-side part 62, which it leaves through outlet 42.

As it flows through conduits 68, the coolant absorbs heat that was transferred from upper side 13 of processor 12 to side 70 of heat absorption element 64 facing toward the processor, and thus also to plates 66.

A heat transfer improvement medium, in particular a thermally conductive film and/or a thermally conductive paste, is preferably arranged between heat absorber 20 and component 12 that is to be cooled. Better heat transfer is thereby obtained.

Figure 7:
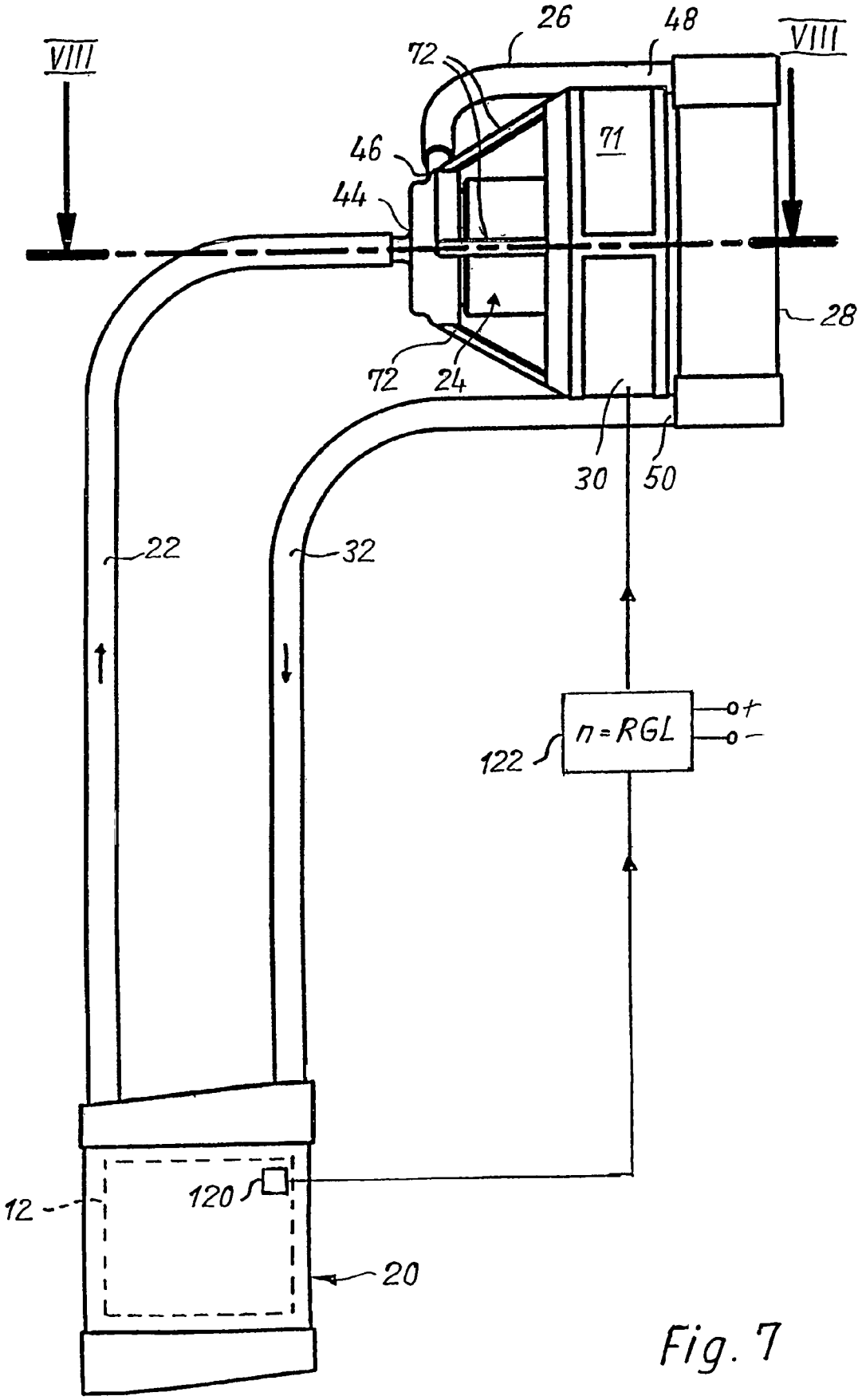
FIG. 7 is a side view of the preferred embodiment of the fluid cooling apparatus according to the present invention shown in FIG. 1.

FIG. 7 is a side view of the preferred embodiment of fluid cooling apparatus 10 according to the present invention shown in FIG. 1.

Figure 8:
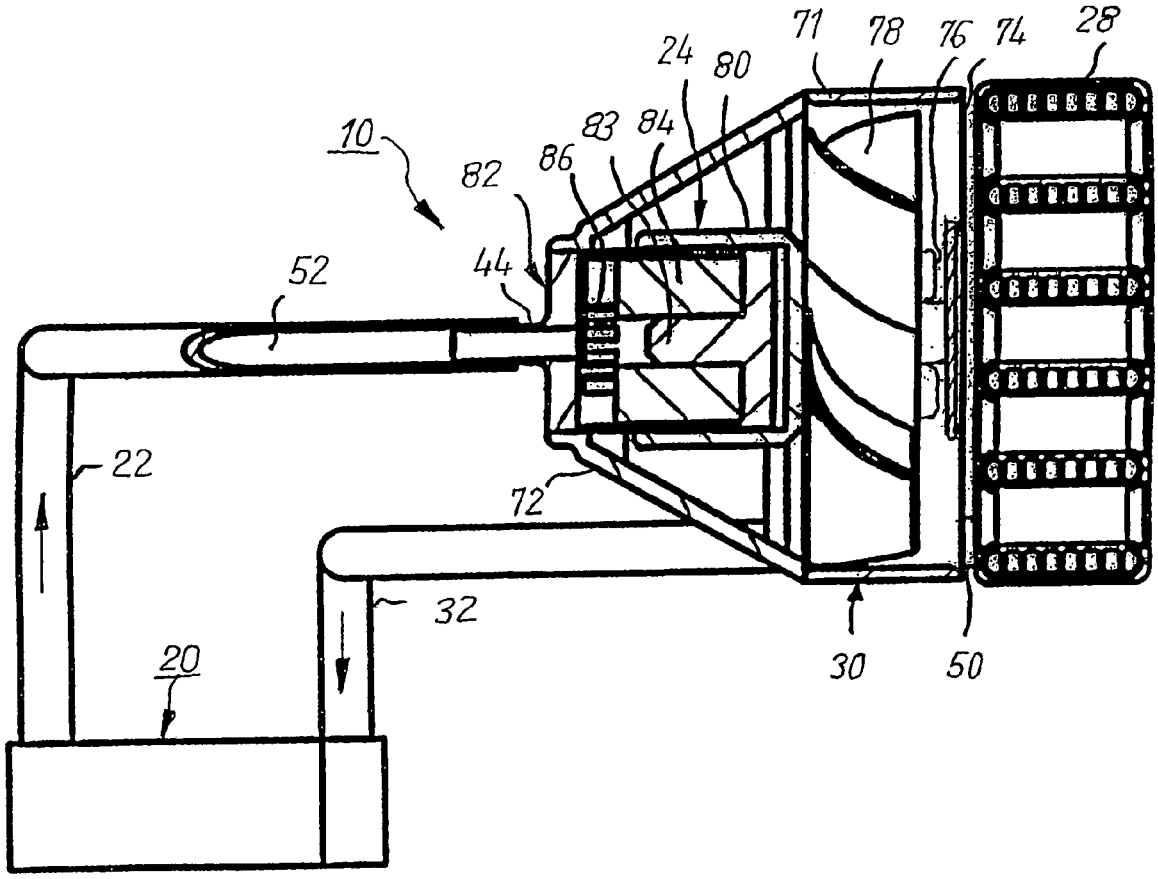
FIG. 8 is a section through the fluid cooling apparatus, looking along line VIII-VIII of FIG. 7.

FIG. 8 is a schematic section through a preferred embodiment of fluid cooling apparatus 10.

Fan 30 comprises a fan housing 71, a stator 76 mounted on the latter via a plurality of spokes 74, and a rotor 78 having fan blades.

Pump 24 comprises a magnet cup 80 connected to rotor 78 of fan 30, a pump housing 82 having a bearing journal 83, and a pump wheel 84 having pump vanes 86.

Pump housing 82 is connected to fan housing 71 via a retaining spider 72.

Heat exchanger 28 is connected to fan 30 on the opposite side from pump 24.

Pump 24 is driven by rotor 78 of fan 30 via a magnetic coupling. For that purpose, magnet cup 80 is immovably connected to rotor 78. Pump housing 82 is retained by retaining spider 72 so that it cannot rotate along with magnet cup 80. Pump wheel 84 is likewise magnetic, and is bearing-mounted in pump housing 82 rotatably via bearing journal 83. Magnet cup 80 is also bearing-mounted via pump housing 82. When magnet cup 80 is rotated by motor 76 of fan 30, pump wheel 84 is therefore also moved, and as a result pump vanes 86 are driven. This causes pumping of coolant 52 on the principle of a centrifugal pump.

Because of the coupling of fan 30 and pump 24, direct regulation of the temperature of component 12 can be accomplished. Lower-noise operation is thus possible if there is less load on processor 12.

The cooling apparatus preferably comprises a rotation speed controller n-RGL 122 for regulating the rotation speed of fan 30. The target rotation speed for the rotation speed controller is preferably determined as a function of a temperature value, that temperature value being ascertained by a temperature sensor 120 mounted on component 12 that is to be cooled.

As alternatives to plastic-on-plastic journal mounting of pump wheel 84 in pump housing 82, mounting by way of a rolling bearing or also a radial bearing configuration is possible.

Figure 9:
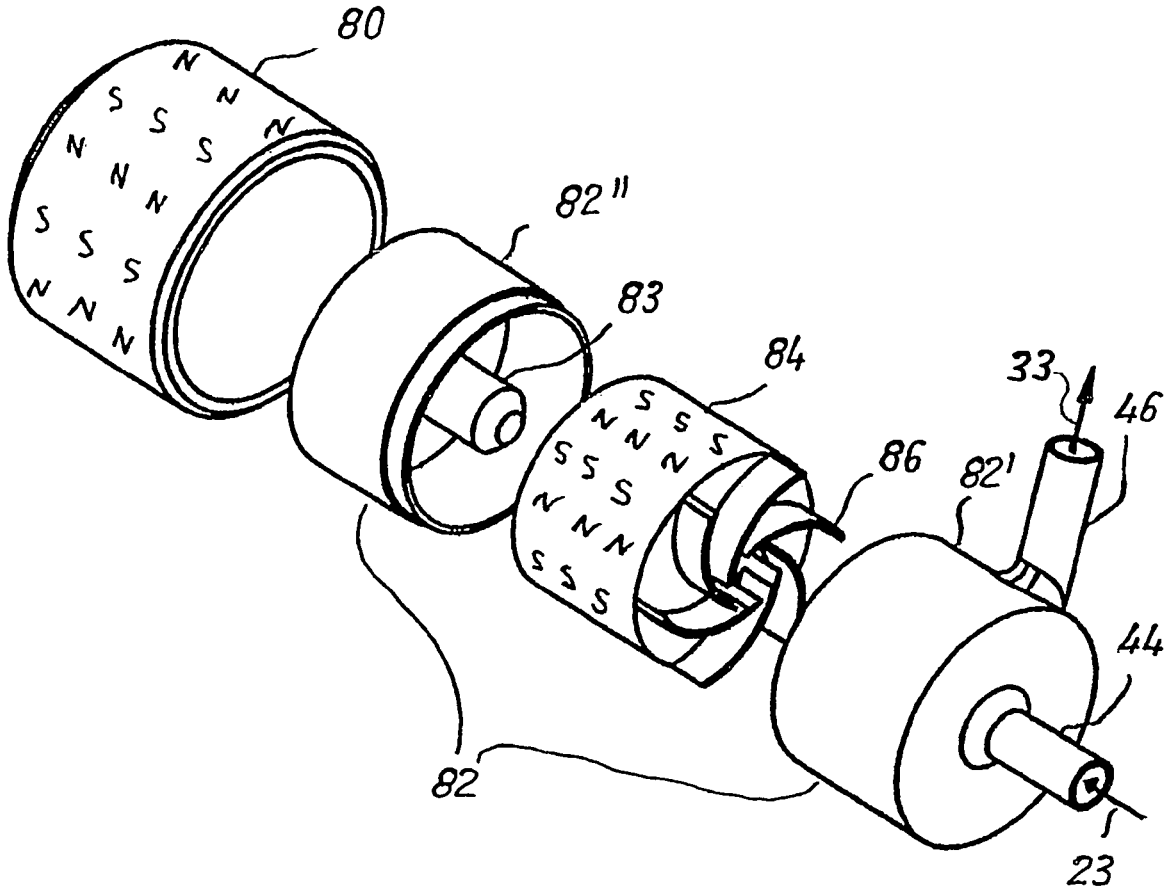
FIG. 9 is an exploded view of a centrifugal pump used as an example in FIG. 1.

FIG. 9 is an exploded view of centrifugal pump 24 that is used by way of example.

Pump housing 82 comprises a first housing part 82' and a second housing part 82". Inlet 44 and outlet 46 are arranged in first housing part 82', and bearing journal 83 in second housing part 82". First housing part 82' and second housing part 82" are produced from a suitable plastic, for example by injection-molding. Connection of the two housing parts is effected, for example, by ultrasonic welding.

Pump wheel 84 comprises pump vanes 86 at its end toward the first housing, and is fabricated from a suitable plastic, for example by injection-molding. Magnet particles or segments, for example hard ferrite powders, are embedded in the plastic, and after injection-molding the desired magnetization is imposed, as indicated in FIG. 9 by N (north pole) and S (south pole). As a result, in addition to its property as a fluid flow generator, pump wheel 84 also has the capability of transferring the magnetic torque generated by magnet cup 80, without a stuffing box, to pump wheel 84.

Magnet cup 80 is manufactured as a deep drawn steel part or steel cup having a magnet ring, or preferably, in the same manner as pump wheel 84, from an injection-moldable plastic having embedded magnetic particles or segments, and the desired magnetization is then imposed as also shown in FIG. 9.

Upon assembly, pump wheel 84 is inserted into second housing part 82", first housing part 82' is pushed on, and the two housing parts 82', 82" are joined in fluid-tight fashion. Pump housing 82 is then moved into magnet bell 80.

What results is a pump 24 with a very low parts count which can be produced inexpensively. With the magnetic coupling, furthermore, it is much easier than with a continuous shaft to achieve freedom from leaks, which is a necessity for use in the interior of a computing system.

Pump wheel 84 and/or magnet cup 80 can alternatively be made not from a plastic having embedded magnet particles but instead, for example, from pressed magnets or pressed magnets injection-embedded in plastic.

Figure 10:
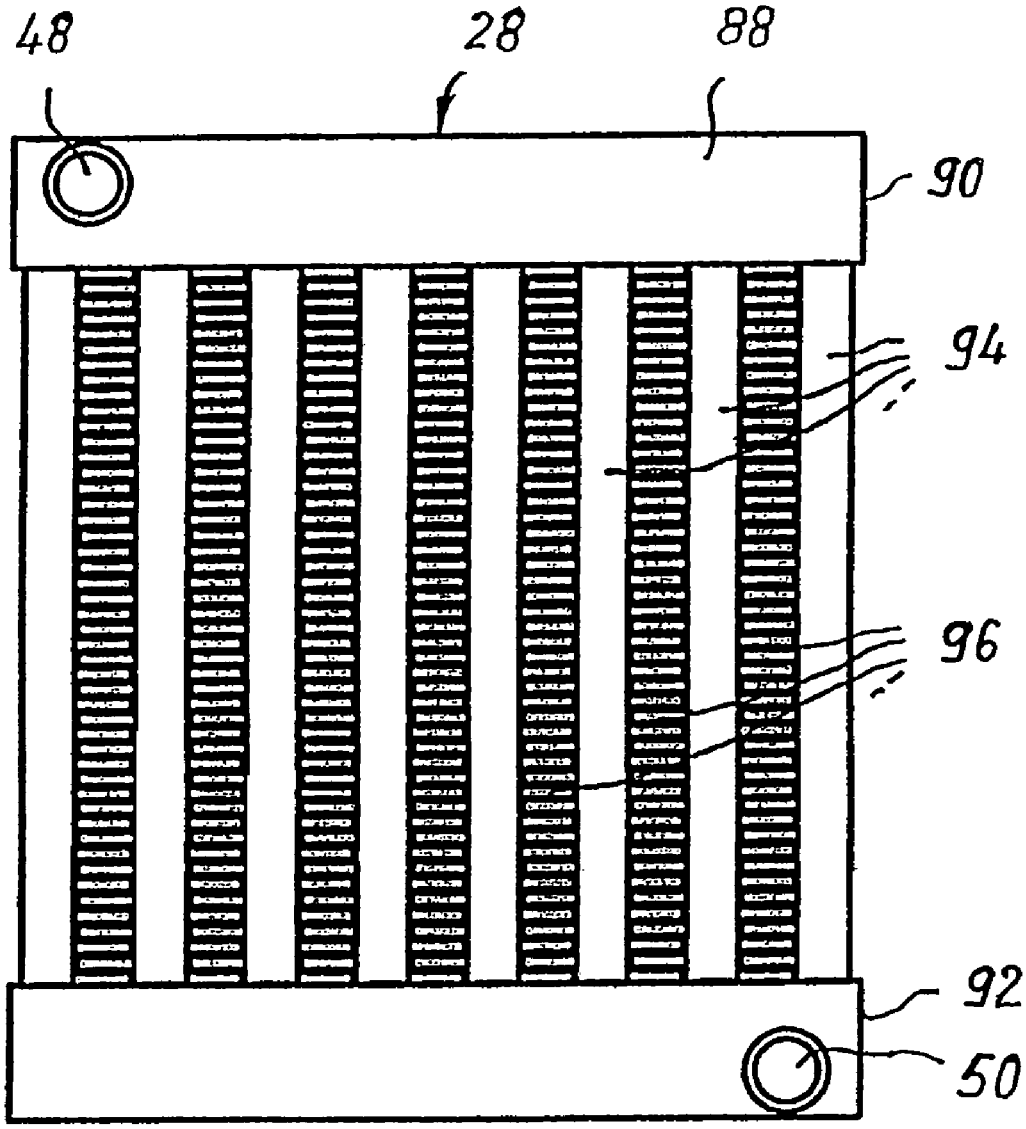
FIG. 10 is a plan view of a heat exchanger 28 as used in FIG. 1.

FIG. 10 is a plan view of a preferred embodiment of heat exchanger 28.

Heat exchanger 28 comprises a housing 88 having an inlet-side part 88 with inlet 48, an outlet-side part 92 with outlet 50, a plurality of conduits 94 that extend between inlet-side part 88 and outlet-side part 92, and a plurality of plate regions 96 extending between conduits 94.

Coolant 72 travels through inlet 48 into inlet-side part 90 of heat exchanger 28; from there it travels through conduits 94 into outlet-side part 92, whence it leaves the heat exchanger through outlet 50.

The air set in motion by fan 30 flows through plate regions 96 that serve to increase the heat-exchange area. For that purpose, the heat exchanger is arranged in the air flow region of fan 30 (see FIG. 8).

The heat transferred from coolant 52 to the air ensures cooling of coolant 52.

Fluid cooling apparatus 10 preferably has further connectors (not depicted) through which lines from further heat absorbers 20 can be connected. They are preferably completely preassembled and filled so that, for example, installation in the computer housing can be performed without difficulty. Fan 30 thus simultaneously ventilates other components in the computer housing, e.g. graphics cards, chipset modules, and hard drives. Overall cooling of the system is thereby improved.

The flow direction of the air preferably proceeds from the heat exchanger outflow side, i.e. the side at which air emerges, directly out of the housing, e.g. out of a computing system. Other components located in the housing are thereby cooled more effectively, which increases the service life of the computing system and/or allows less air flow. This minimizes noise.

Ventilation slots are preferably located in the housing on the side opposite the heat exchanger, so that the components located in the housing are continuously cooled in the resulting air flow. The heat exchanger functions simultaneously as a noise suppressor for the air flowing out of the housing.

Fluid cooling apparatus 10 requires very little space and has very little mass in the vicinity of component 12 to be cooled.

The magnetic coupling of fan 30 and pump 24 reduces the space requirement, parts count, and therefore manufacturing costs. There is moreover no need for an additional electrical connector for pump 24.

Electric motor 76, for example an electronically commutated external- or internal-rotor motor, can preferably be regulated in terms of its rotation speed, for example as a function of the temperature of component 12 to be cooled (see FIG. 7). As a result, the cooling capacity or rotation speed can be kept as low as is necessary, and needs to be increased only if the ambient temperature and/or computing power is correspondingly high. The noise generated is thus likewise diminished; this is very advantageous, for example, in the context of a computing system in an office.

The heat absorber and heat exchanger are preferably implemented using flat-tube technology. An extremely compact configuration, maximum power density, and decreased weight can thereby be achieved. This is very advantageous when the heat absorber is placed directly on a processor to be cooled in a computer, since processors have little capacity for mechanical stress and the available heat transfer area is very small.

Deep drawn parts are preferred for inlets and outlets 60, 62, 90, 92.

Plates 96 are preferably used in order to improve the efficiency of the flat tubes.

The flat tubes are preferably extruded parts.

It is advantageous in terms of heat transfer that the base surface of the heat absorber is flat and exhibits little surface roughness.

All the aforementioned elements can be manufactured and assembled very economically, so that the product as a whole can be manufactured inexpensively.

A radial fan is preferably selected as the fan, in which context the heat exchanger can preferably be arranged around the enveloping surface of the radial fan. Mounting the heat exchanger around the enveloping surface of the radial fan increases the heat exchanger area and therefore the cooling capacity. The heat exchanger comprises, for example, fluid conduits that extend on the enveloping surface from one end face of the radial fan to the opposite end face.

Figure 11:
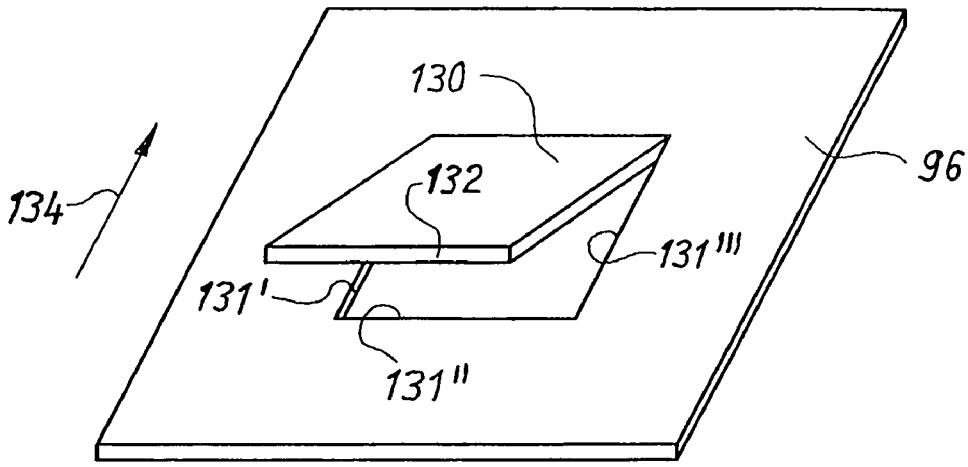
FIG. 11 shows a plate of a heat exchanger having a bent-out sheet-metal part.

FIG. 11 shows a portion of a plate 96 of heat exchanger 28 having a bent-out sheet-metal part 130 that is referred to as a "shutter." Bent-out sheet-metal part 130 is produced by stamping out three sides 131', 131", and 131'" forming a "U," and then bending out sheet-metal part 130 defined by the three sides 131', 131", and 131'". Application of a plurality of such bent-out sheet-metal parts 130 to plates 96 results, for example, in an 80% improvement in the cooling capacity of the heat exchanger. Open end 132 of bent-out sheet-metal part 130 preferably faces the opposite way from direction 134 of the air flow through heat exchanger 28.

Figure 12:
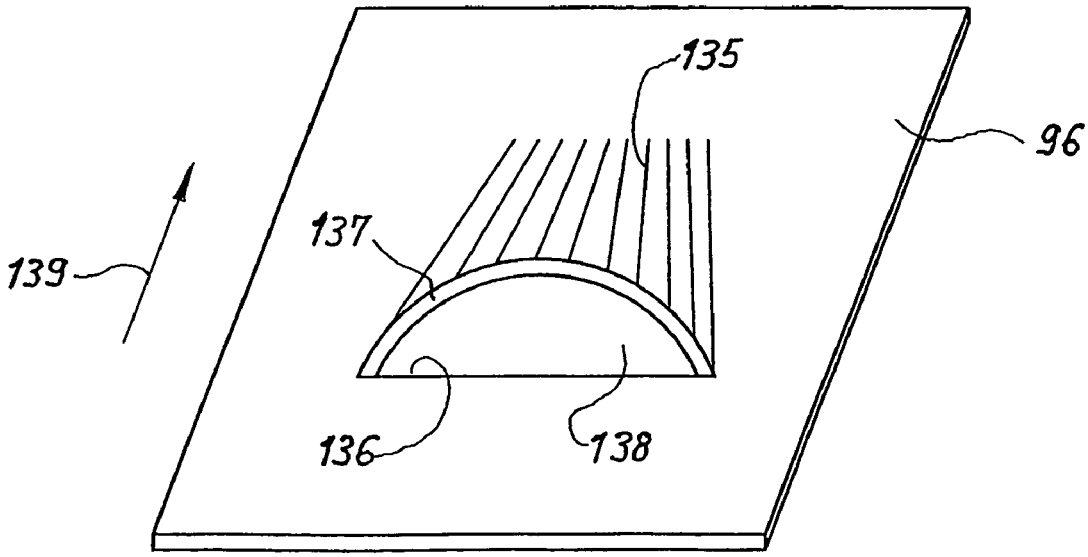
FIG. 12 shows a plate of a heat exchanger having a preferred embodiment of a bent-out sheet-metal part.

FIG. 12 shows a portion of a plate 96 of heat exchanger 28 having a further embodiment of a bent-out sheet-metal part 135. The latter is produced by making a cut 136 into plate 96, followed by deep-drawing and bending out. The bending-out operation creates an opening 138 through which air can flow. Open side 137 of the bent-out sheet-metal part is preferably oriented oppositely to direction 139 of the air flow.

Figure 13:
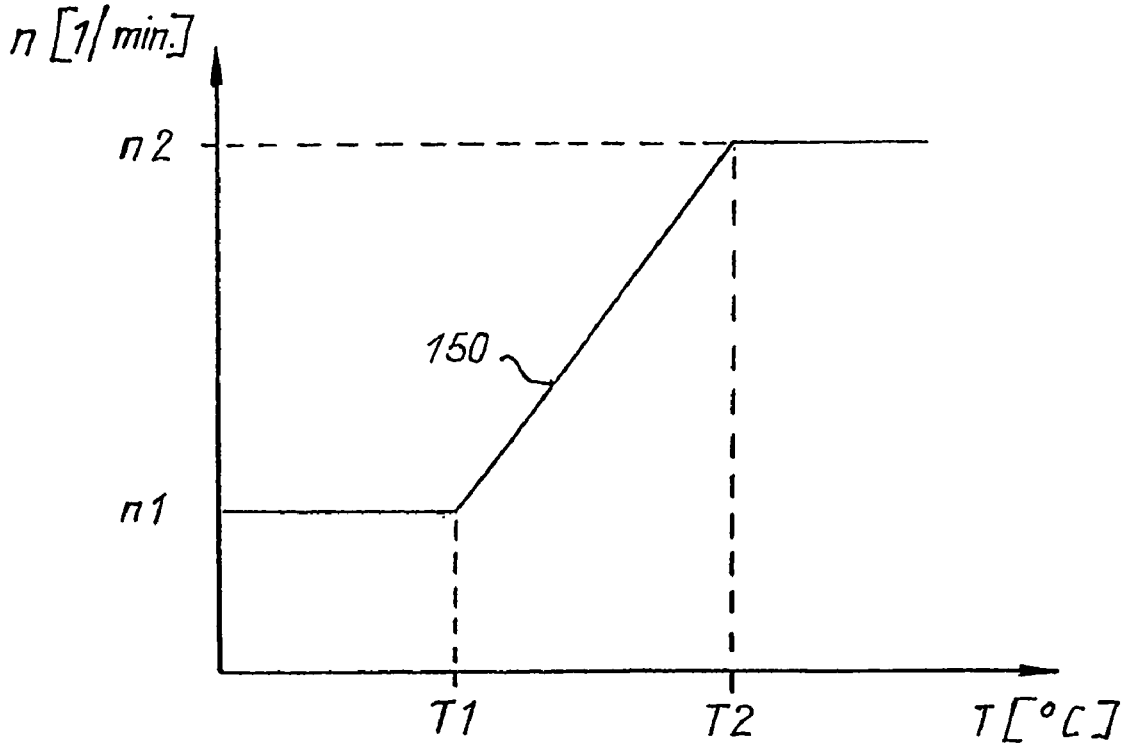
FIG. 13 shows a temperature/rotation speed characteristic curve for determining the necessary rotation speed.

FIG. 13 shows a preferred exemplifying embodiment of a temperature/rotation speed characteristic curve 150 that indicates rotation speed n of fan 30 of liquid cooling system 10, and thus also the rotation speed of pump 24. This temperature/rotation speed characteristic curve 150 is preferably used in conjunction with a measurement of the temperature of coolant 52. For that purpose, sensor 120 (see FIG. 7) is preferably positioned in the vicinity of microprocessor 12 at a point in the coolant circuit at which the coolant has already absorbed the heat of microprocessor 12.

The rotation speed of fan 20 is controlled in open- or, preferably, closed-loop fashion as a function of rotation speed value n resulting from temperature/rotation speed characteristic curve 150. A Negative Temperature Coefficient (NTC) resistor can be used as sensor 120.

According to the temperature/rotation speed characteristic curve, up to a first temperature T1 (e.g. 30 degrees C.) a minimum rotation speed n1 is defined at which fan 30 works very quietly. The result is that a minimum cooling level is continuously maintained, as experience has indicated is necessary. If temperature T in the coolant rises to T>T1, rotation speed n of fan 30 is then increased until at a temperature T2 (e.g. 70 degrees C.), maximum rotation speed n2 of fan 30 is reached. At this operating point the flow velocities in both the closed-circuit fluid flow and the open-circuit fan flow are maximal, and maximum heat transfer is established. The maximum heat load is therefore also being dissipated. The dependence of rotation speed n on temperature T is shown as being linear, but in other instances can have a different, e.g. exponential, character.

In the case of components to be cooled that have an internal temperature sensor, in particular microprocessors, the sensor's temperature information can also be utilized to determine rotation speed n. The temperature information is picked off for this purpose, for example, at a suitable location on the main circuit board.

Figure 14:
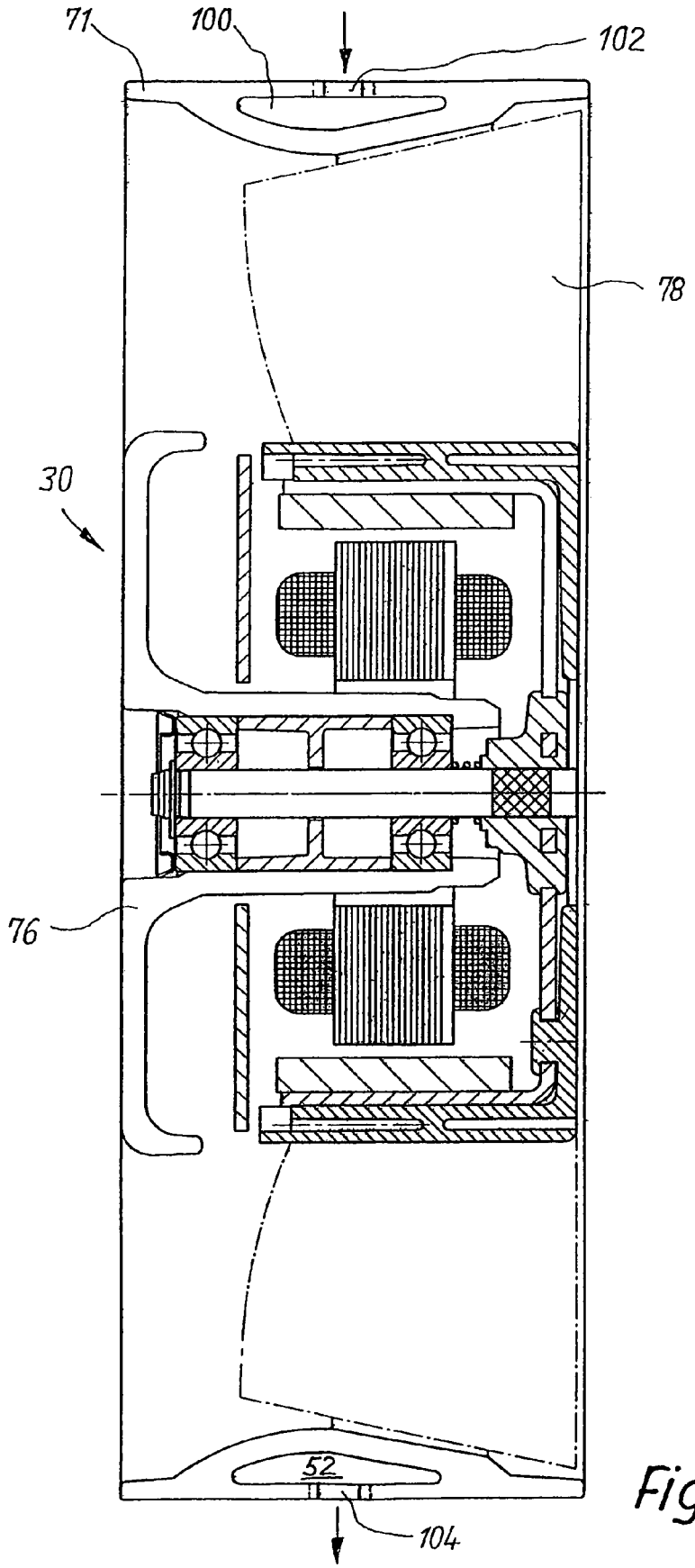
FIG. 14 shows a fan having a fluid conduit for passage of a coolant.

FIG. 14 shows a preferred exemplifying embodiment of a fan 30 for use in a fluid cooling apparatus 10. Only fan 30 is depicted, without pump 24.

Fan housing 71 of fan 30 comprises a fluid conduit 100 through which a coolant 52 can be conveyed. Fluid conduit 100 comprises an inlet 102 and an outlet 104. Coolant can flow into fan housing 71 through inlet 102, and flow out through outlet 104.

Because coolant 52 is being pumped through fan housing 71, on the one hand a further cooling of coolant 52 takes place (i.e. the fan also acts as a heat exchanger), and on the other hand fan 30 is effectively protected from overheating. For this purpose, fluid conduit 100 is preferably additionally routed past the electrical components of stator 76. The fan preferably comprises further fluid conduits in addition to fluid conduit 100.

For better heat transfer, the fan housing preferably comprises cooling fins that are arranged on the surface of fan 30 and/or project into fluid conduit 100.

Fan housing 71 is preferably made from a thermally conductive plastic. This enables better heat transfer between coolant 52 and the fan housing surface at which heat dissipation takes place.

In a preferred embodiment of the invention, pump 24 is removable from fan 30 (FIG. 8), i.e. pump 24 and fan 30 are connected detachably. This is achieved, for example, by way of a screw connection or quick-release coupling between pump 24 and fan 30. Pump retaining member 72, in particular, is detachable from pump 24 and/or from fan 30 for this purpose. This embodiment has the advantage that fan 30 can be replaced independently of the coolant circuit. It is thus unnecessary to drain the coolant when replacing fan 30.

Heat absorber 20 (FIG. 2 and FIG. 3) preferably comprises, on its outer side, cooling fins (not depicted) with which additional cooling of coolant 52 flowing through heat absorber 20 is achieved. It is also preferred if heat absorber 20 comprises on its outer side an additional fan (not depicted) with which additional cooling of coolant 52 flowing through heat exchanger 20 can likewise be achieved.

Coolant lines 22, 26, 28 are preferably constituted by metal hoses, since the latter exhibit good aging resistance, fluid-tightness, and heat dissipation. Bendable corrugated tubes are also preferably used.

The invention claimed is:

1. An arrangement for cooling a component, comprising a pump for pumping a coolant, which pump has a pump rotor composed of a plastic material with a plurality of magnetic particles or segments embedded in said mass of non-magnetic material;

a fan having a fan rotor and an electric motor to drive it, a magnetic cup connected to the fan rotor, the pump rotor and the fan rotor being separated from one another in fluid-tight fashion and drivingly connected to one another via a magnetic coupling occurring, during rotation, by magnetic interaction among said magnetic cup and said pump rotor.

2. The arrangement according to claim 1, the pump rotor comprising a plurality of pump vanes (86) for generating a flow of the coolant (52).

3. The arrangement according to claim 2, the pump vanes being implemented integrally with the pump rotor (84).

4. The arrangement according to claim 1, the fan (30) having a fan housing (71) and the pump (24) having a pump housing (82) ; and further comprising a pump retaining member (72) that connects the fan housing (71) to the pump housing (82).

5. The arrangement according to claim 4, wherein the fan housing (71) and the pump retaining member (72) are implemented integrally.

6. The arrangement according to claim 1, further comprising a heat exchanger (28) for cooling the coolant (52), which exchanger is located in an air flow region of the fan (30) and is in fluid communication with the pump (24) for the coolant (52).

7. The arrangement according to claim 6, wherein the heat exchanger (28) is implemented as a flat-tube heat exchanger.

8. The arrangement according to claim 6, the heat exchanger (28) comprising a plurality of plates (96) for the passage of air.

9. The arrangement according to claim 8, the plates (96) comprising a plurality of shutters (130, 135) for improving the absorption of heat by the air passing through.

10. The arrangement according to claim 6, the heat exchanger (28) comprising a heat exchanger housing (88) and the fan (30) comprising a fan housing (71); and the heat exchanger housing (88) and fan housing (71) being implemented integrally.

11. The arrangement according to claim 10, further comprising a pump retaining member (72) that connects the fan housing (71) to the pump (24), the heat exchanger housing (88), the fan housing (71), and the pump retaining member (72) being implemented integrally.

12. The arrangement according to claim 6, which comprises a heat absorber (20) for cooling a component, which heat absorber (20) is in fluid communication both with the pump (24) and with the heat exchanger (28) and forms with them a coolant circuit.

13. The arrangement according to claim 12, the heat absorber (20) comprising external cooling fins.

14. The arrangement according to claim 12, an additional fan being associated with the heat absorber (20) for cooling.

15. The arrangement according to claim 12, comprising a component (12) to be cooled, a heat transfer improvement medium, being arranged between the heat absorber (20) and the component (12) to be cooled.

16. The arrangement according to claim 12, the heat absorber (20) being implemented as a flat-tube heat absorber.

17. The arrangement according to claim 16, the heat absorber (20) comprising a heat absorption element (64) that is manufactured from a material selected from the group consisting of copper and aluminum.

18. The arrangement according to claim 1, further comprising a rotation speed controller (122) associated with the electric motor (76).

19. The arrangement according to claim 18, further comprising a temperature sensor (120) that is connected to the rotation speed controller (122) in order to control a temperature-dependent rotation speed.

20. The arrangement according to claim 19, wherein the temperature sensor (120) is a Negative Temperature Coefficient (NTC) resistor.

21. The arrangement according to claim 19, wherein the temperature sensor (120) is located adjacent the heat absorber (20).

22. The arrangement according to claim 19, wherein the temperature sensor (120) is arranged adjacent a component (12) to be cooled.

23. The arrangement according to claim 19, wherein the temperature sensor (120) is arranged at least partly in the coolant, in thermally conductive relation to a circuit of said coolant.

24. The arrangement according to claim 1, wherein the fan (30) is implemented as a radial fan.

25. The arrangement according to claim 1, wherein the fan (30) and the pump (24) are connected detachably to one another.

26. The arrangement according to claim 25, the fan (30) and the pump (24) being connected to one another via a quick-release coupling.

27. The arrangement according to claim 1, further comprising metal conduits for fluid circulation of said coolant.

28. The arrangement according to claim 1, wherein the fan (30) is formed with a fluid conduit (100) for conveying a coolant (52) therethrough.

29. The arrangement according to claim 28, wherein the fan (30) comprises a fan housing (71) , and the fluid conduit (100) is implemented in the fan housing (71).

30. The arrangement according to claim 29, wherein the fan housing (71) comprises cooling fins.

31. The arrangement according to claim 29, wherein the fan housing (71) comprises a thermally conductive plastic.

32. The arrangement according to claim 28, wherein the fan (30) comprises a stator (76) having electrical components, the fluid conduit (100) being routed past the electrical components of the stator (76) for cooling.

33. A method of cooling a component, using an apparatus including a temperature sensor (120), a fan (30) having a fan rotor (78) and a drive motor (76), a pump (24) having a pump rotor (84), a coolant (52) that is pumpable by means of the pump (24), a magnetic coupling (80, 84) that drivingly connects the fan rotor (78) and the pump rotor (84), and a drive motor rotational speed controller (122), comprising the steps of:

sensing temperature using said temperature sensor (120) and generating a corresponding temperature output value, associating said temperature output value, in said rotational speed controller (122), with a corresponding target rotation speed, driving the fan rotor (78) toward said target rotation speed by means of the drive motor (76) in accordance with control signals applied by said speed controller to said motor (76);

imparting a rotational motion to the pump rotor (84), via the magnetic coupling (80, 84), by means of the rotational motion of the fan rotor (78) ; and causing the coolant (52) to flow by the rotational motion of the pump (84).

34. The method according to claim 33, using a heat exchanger (28) to cool the coolant, which exchanger is in fluid communication with the pump (24), which method additionally comprises the following steps:

air is caused to flow by the rotational motion of the fan rotor (78);

the coolant (52) is pumped through the heat exchanger (28) by the pump (24);

the coolant is cooled by the flow of heat from the coolant (52) to the air that has been caused to flow.

35. The method according to claim 34, using a heat absorber (20) to cool a component, which exchanger is in fluid communication with the pump (24) and the heat exchanger (28), which method additionally comprises the following step:

the coolant (52) is pumped through the heat absorber (20) by the pump (24).

36. The method according to claim 35, the pump (24), the heat exchanger (28), and heat absorber (20) forming a coolant circuit, which method additionally comprises the following step:

the coolant is pumped through the coolant circuit in the sequence: pump (24), heat exchanger (28), heat absorber (20), pump (24).

37. The method according to claim 36, the pump (24), the heat exchanger (28), and the heat absorber (20) forming a coolant circuit, which method additionally comprises the following step:

the coolant (52) is pumped through the coolant circuit in the sequence: pump (24), heat absorber (20), heat exchanger (28), pump (24).

38. The method according to claim 34, using a housing, in which the heat exchanger is located, which method additionally comprises the following step:

the air heated by the heat exchanger (28) is discharged directly from the housing.

39. The method according to claim 38, further comprising the step of:

directing the air flowing into the housing, as a result of the rotational motion of the fan rotor (78), over any components located in the housing.

* * * * *